United States Patent [19]

Kobayashi et al.

[11] Patent Number: 4,918,965

[45] Date of Patent: Apr. 24, 1990

[54] MULTIHIGH ROLLING MILL

[75] Inventors: Kazuo Kobayashi, Naka; Toshiyuki Kajiwara, Hitachi; Teruo Sekiya, Takahagi; Tomoaki Kimura, Hitachi, all of Japan

[73] Assignee: Hitachi, Ltd., Tokyo, Japan

[21] Appl. No.: 183,735

[22] PCT Filed: Jul. 31, 1987

[86] PCT No.: PCT/JP87/00574

§ 371 Date: Feb. 24, 1988

§ 102(e) Date: Feb. 24, 1988

[87] PCT Pub. No.: WO88/00862

PCT Pub. Date: Feb. 11, 1988

[30] Foreign Application Priority Data

Aug. 8, 1986 [JP] Japan ..... 61-185121

[51] Int. Cl.[5] ..... B21B 13/14

[52] U.S. Cl. ..... 72/243; 72/242

[58] Field of Search ..... 72/242, 241, 243, 245, 72/247

[56] References Cited

U.S. PATENT DOCUMENTS

| | | | |
|---|---|---|---|
| 1,614,425 | 1/1927 | Coe | 72/242 |
| 2,776,586 | 1/1957 | Sendzimir | 72/242 |
| 3,429,166 | 2/1969 | Baker et al. | 72/242 |
| 4,270,377 | 6/1981 | Verbickas et al. | 72/242 |
| 4,539,834 | 9/1985 | Iwanami | 72/243 |

FOREIGN PATENT DOCUMENTS

| | | | |
|---|---|---|---|
| 0130307 | 10/1980 | Japan | 72/242 |
| 0130310 | 10/1980 | Japan | 72/242 |

*Primary Examiner*—W. Donald Bray

*Attorney, Agent, or Firm*—Fay, Sharpe, Beall, Fagan, Minnich & McKee

[57] ABSTRACT

A multi-high rolling mill has upper and lower work rolls, upper and lower backup rolls, and an intermediate roll disposed therebetween. All of the work rolls, backup rolls and intermediate roll are arranged in a perpendicular direction. The intermediate rollers support the work rolls in the direction of a path of the work, and the support rollers support intermediate rollers. Each of the support rollers has a plurality of divisional rollers arranged in the axial direction of the support roller so that the axes of the divisional rollers are spaced from one another in the vertical direction. In other words, the divisional rollers are staggered alternately in the axial direction of the support roller. A space can be secured between each support roller and associated backup roll, to support the associated work roll in the substantially perpendicular direction. The support roller, backup roll, and intermediate roll do not contact each other. This enables the diameter of the work rolls to be minimized. Moreover, each intermediate roller directly supporting the associated work roll is reliably supported by two divisional rollers, the axes of which are spaced from each other.

28 Claims, 8 Drawing Sheets

FIG. 2
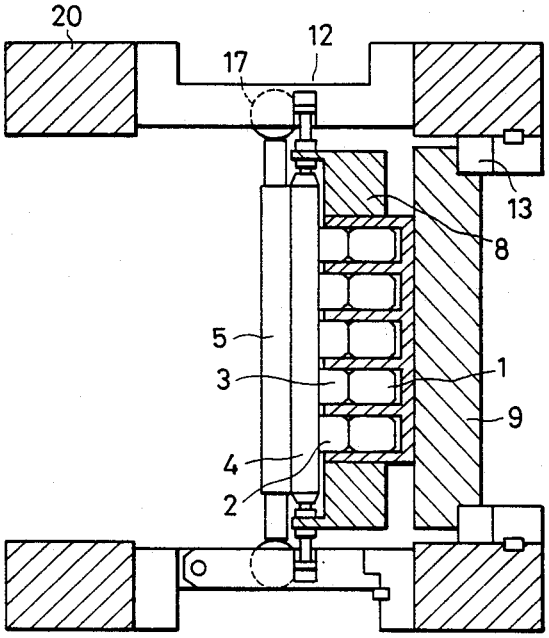
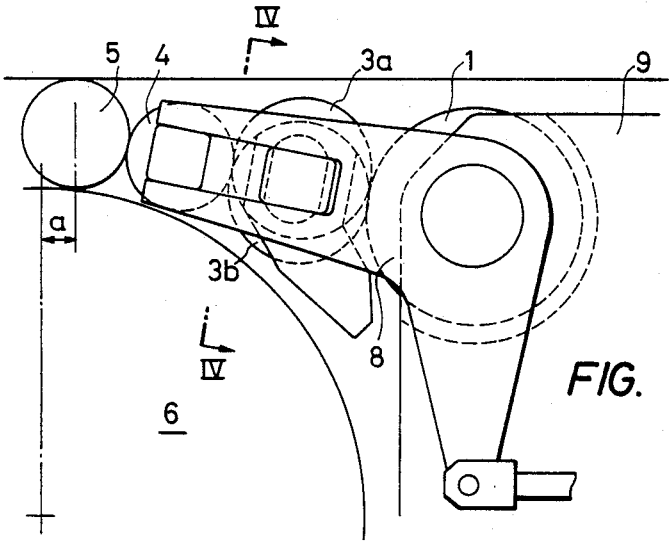
FIG. 3

MULTIHIGH ROLLING MILL

TECHNICAL FIELD:

This invention relates to a multihigh cold rolling mill, and more particularly to a multihigh rolling mill provided with support rolls which are arranged in a horizontal direction with respect to the work rolls which are when small-diameter work rolls suitable for the rolling of hard materials and thin plate materials are employed.

BACKGROUND ART:

It has been demanded in the industrial field that the techniques for rolling a hard material or a material difficult to be processed or a thin plate with a reduced rolling load are accomplished by using work rolls of a miniaturized diameter. To meet this demand, a 20-high rolling mill called a Sendzimir mill and disclosed in U.S. Pat. No. 2,776,580 has long been used, in which, however, it is difficult to set the crown and shape of a plate material to be rolled to predetermined permissible levels. In the case of a rolling mill which is obtained by improving a conventional 4-high rolling mill, and which employs small-diameter work rolls, a backup roll driving system is necessarily adopted. Due to this driving system, a tangential force is applied from the backup rolls to the work rolls, so that the axial flexure of the work rolls occurs in the lateral direction. In order to prevent this axial flexure, various types of rolling mills have been developed, which include a so-called MKW mill (refer to U.S. Pat. No. 4,598,566), a support roller-carrying 5-high mill (refer to U.S. Pat. Nos. 4,577,480 and 4,539,834), and a support roller-carrying 6-high mill (refer to U.S. Pat. Nos. 4,270,377; 4,563,888 and 4,531,394), in all of which a primary rolling load is supported by unitarily-formed backup rolls with support rollers provided substantially in the same plane as the work rolls so as to prevent the lateral flexure of the work rolls, i.e. the axial flexure thereof in the direction of the path of a material to be rolled.

These various types of rolling mills are divided into two groups depending upon the support systems employed therein for supporting the small-diameter work rolls by the support rollers disposed along the path of the material to be rolled.

(i) Rolling mills in which the work rolls are supported by support rollers with the work rolls and support rollers arranged so that the centers of the side surfaces thereof are on one straight line (refer to U.S. Pat. Nos. 4,598,566; 4,577,480 and 4,563,888).

(ii) Rolling mills in which a plurality of rows of support rollers are provided, by which the idle rollers provided between the work rolls and support rollers are stably supported (refer to U.S. Pat. Nos. 4,270,377 and 4,531,394).

In the work roll supporting system in the rolling mills in (i), the work rolls, idle rollers and support rollers are arranged in the mentioned order so that the centers of the the side surfaces thereof are substantially on one straight line. If the centers of the side surfaces of the work rolls, idle rollers and support rollers in the support system in (i) are out of a straight line connecting these centers, a bending force based on the force generated by the work rolls is exerted, especially, on the idle rollers. Therefore, it becomes necessary that the diameter of the idle rollers be increased to a certain extent, and, due to such dynamic restrictions, the diameter of the work rolls cannot be reduced, either.

In the work roll supporting system in (ii), the support rollers supporting the idle rollers, which are disposed in contact with and in substantially the same plane as the work rolls, are provided in a plurality of rows, and the force generated by the work rolls can be supported in a dynamically stabilized state. However, a space for holding two support rollers is required, so that the extent to which the diameter of the work rolls can be reduced is limited.

The present applicant developed 6 high rolling mills having a greatly-improved capability of controlling the crown and shape of a plate type material to be rolled, as disclosed in U.S. Pat. Nos. 3,818,743 and 4,369,646. In these rolling mills, axially-shiftable intermediate rolls are provided between the backup rolls and work rolls, and bending means on the work rolls or the work rolls and intermediate rolls, for the purpose of improving the capability of controlling the shape of the material to be rolled, an intermediate roll shifting operation and a roll bending action being suitably combined.

The present applicant also proposed a rolling mill, which is disclosed in U.S. Pat. No. 4,614,103, and which is provided with horizontal support rollers and horizontal backup rollers as means for reducing the flexure, which poses problems when the diameter of the work rolls in the 6 high rolling mill disclosed in U.S. Pat. No. 4,369,646 is further reduced, of the work rolls in the direction of the path of the material, which support rollers and backup rollers are arranged so that the centers of the side surfaces thereof are on one straight line, a pre-stress being applied to the work rolls via a roller-supporting frame. The present applicant also filed as a prior application an application directed to a multihigh rolling mill which is obtained by improving the above-described multihigh rolling mill in which the horizontal support rollers and horizontal backup rollers, which support the small-diameter work rolls, are arranged so that the centers of the side surfaces thereof are on one straight line. The multihigh rolling mill in this prior application is constructed by making pivotable the frame, which support these rollers, and engaging the this frame with a hydraulic cylinder, in such a manner that a vertical bending force can be applied effectively to the small diameter work rolls. (U.S. patent application Ser. No. 847,489 corresponding to German Patent Laid-open No. DE-OS 3,610,889) It has been demanded in the industrial world that, when an extremely thin material of not more than 0.2 mm in thickness or a thin hard plate, such as a stainless steel plate is rolled, work rolls the diameter of which is reduced to as great an extent as possible be used so as to set the rolling reduction to as high a level as possible. However, the results of the analyses and researches conducted by the present inventors show that, when work rolls and intermediate rolls of reduced diameters are used in the rolling of a work of, for example, 1300 mm in width, the end portions of the work which have a width corresponding to about ¼ of a total width thereof are curved upward and downward, i.e., the so-called quarter buckling occurs in these end portions of the work, so that the surface of the work is waved. When the quarter buckling has once occurred in a work, it is considerably difficult to remove the same, and various troubles occur in the later processing steps. Therefore, in order to reduce the diameter of the work rolls, it is necessary that the diameter of the intermediate rolls be increased to a certain extent. However, increasing the diameter of the intermediate rolls has the following problems. In the multihigh rolling mills disclosed in U.S. Pat. Nos. 4,270,377 and 4,531,394, which are provided with a plurality of rows of support rollers, an intermediate roll 6 is provided between a small-diameter work roll 5 and a backup roll 7, and intermediate rollers 4 on both sides, in the horizontal direction, of the small-diameter work roll 5, each of which intermediate rollers 4 is supported on upper and lower support rollers 13, 14, as shown in, for example, FIG. 6*a* out of FIGS. 6*a*–6*c*. Thus, the intermediate rollers 4 are disposed stably without interfering with the intermediate rolls 6, so that the lateral (horizontal) movement of the work roll 5 is restricted sufficiently. However, when the diameter of the work roll 5 $D_{Wb}$ is further reduced in comparison to $D_{Wa}$, shown in FIG. 6*a*, and the diameter of the intermediate roll 6 $D_{Ib}$ is increased as compared with that of the intermediate roll of FIG. 6*a* $D_{Ia}$, as shown in FIG. 6*b*, the upper support roller 13 and intermediate roll 6 interfere with each other, so that this structure does not function as a rolling mill.

DISCLOSURE OF THE INVENTION:

An object of the present invention is to provide a multihigh rolling mill capable of rolling a hard material or a material of a small thickness by using small-diameter work rolls supported by support rollers, and of carrying out a rolling operation with a high accuracy in a stable condition without causing quarter buckling to occur in the material.

The characteristics of the present invention reside in a multistep rolling mill having a plurality of work rolls and backup rolls, and work roll-supporting intermediate rollers and intermediate roller-supporting support rollers both of which types of rollers are arranged in the direction of the path of a work, therein each of the support rollers consists of a plurality of divisional rollers which are arranged in a staggered or zig zag manner in the axial direction of the support roller so that the axes of adjacent divisional rollers are spaced from one another in the vertical direction. Owing to these constructional characteristics, the present invention has the following operation and effects.

(1) Realization of the reduction of the diameter of the work rolls:

According to the present invention, a space can be secured between a support roller and a backup roll, which supports a small-diameter work roll substantially in the perpendicular direction, or an intermediate roll, so that the support roller and the backup roll or intermediate roll do not contact each other. This enables the diameter of the work rolls to be minimized.

(2) Realization of highly-accurate stable rolling:

According to the present invention, the intermediate rollers directly supporting the work rolls are rigidly supported by the divisional rollers the axes of which are spaced from one another, so that the work rolls can be stably supported. Therefore, a rolling operation can be carried out stably with a high accuracy.

BRIEF DESCRIPTION OF THE DRAWINGS:

FIG. 2 is a sectional view of the support rollers, which are arranged in the direction of the path of a work, in the rolling mill of FIG. 1;

FIG. 3 is a side elevation of the support rollers shown in FIG. 2;

Figures 1A, 1B:
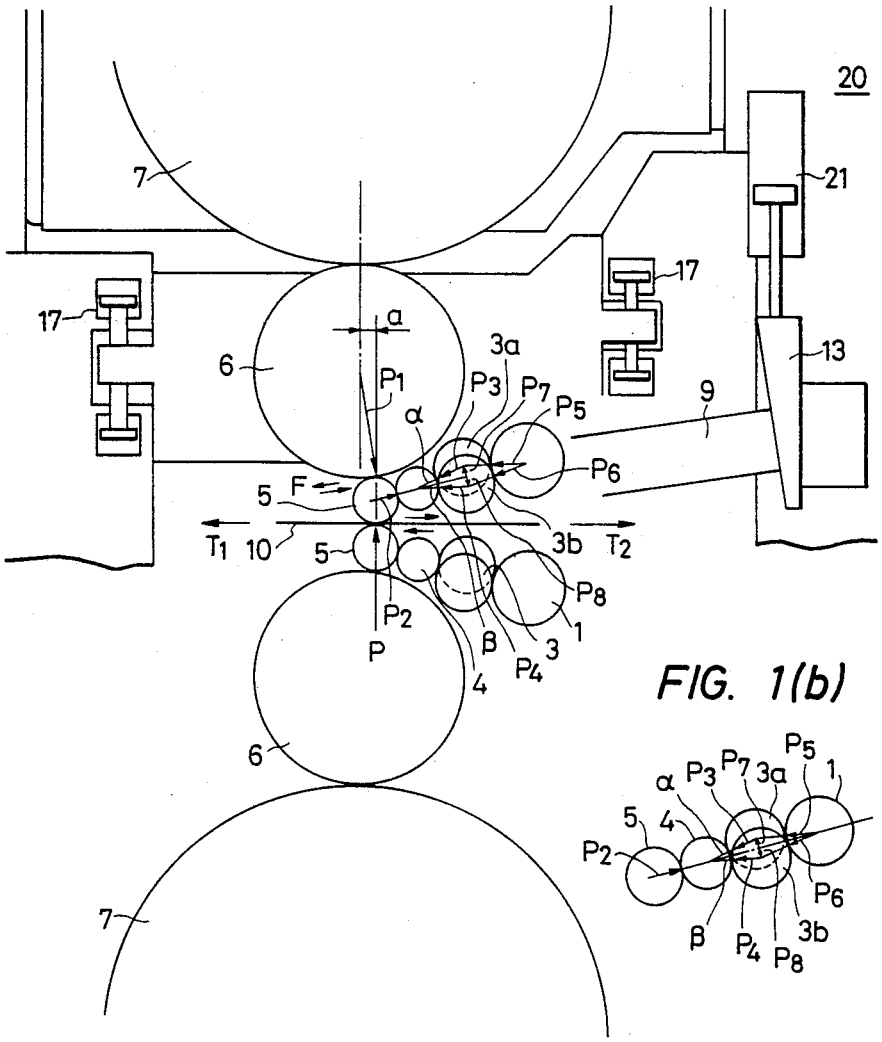
FIG. 1*a* is a construction diagram of an embodiment of a 6-high rolling mill provided with support rollers according to the present invention.
FIG. 1*b* illustrates the directions of the force acting among the support rollers shown in FIG. 1.

BEST MODE FOR CARRYING OUT THE INVENTION:

The basic construction of the rolling mill to which the present invention is applied is substantially identical with that of the rolling mill disclosed in U.S. Pat. No. 4,369,646 referred to above, except with respect to the construction of the support roller mechanism which supports the work rollers in the horizontal direction. FIG. 1 shows a 6-high rolling mill, an embodiment of the present invention. Referring to FIG. 1, the upper and lower work rolls 5 are supported on the axially movable intermediate rolls 6, which are supported on the upper and lower backup rolls 7. These rolls 5, 6, 7 are arranged in a substantially linear direction. The work rolls 5 are disposed in the positions which are spaced by a distance a along the path of a work 10 from the axes of the intermediate rolls 6 and backup rolls 7. The diameter of each work roll 5 is set to a low level so as to roll a hard material or a thin plate of preferably not more than 0.2 mm. The diameter of the work roll 5 is set selectively to about 20%–5% of a maximum width of the work 10, i.e., to about 200–50 mm when a maximum width of the work is 1000 mm.

Figure 7A:
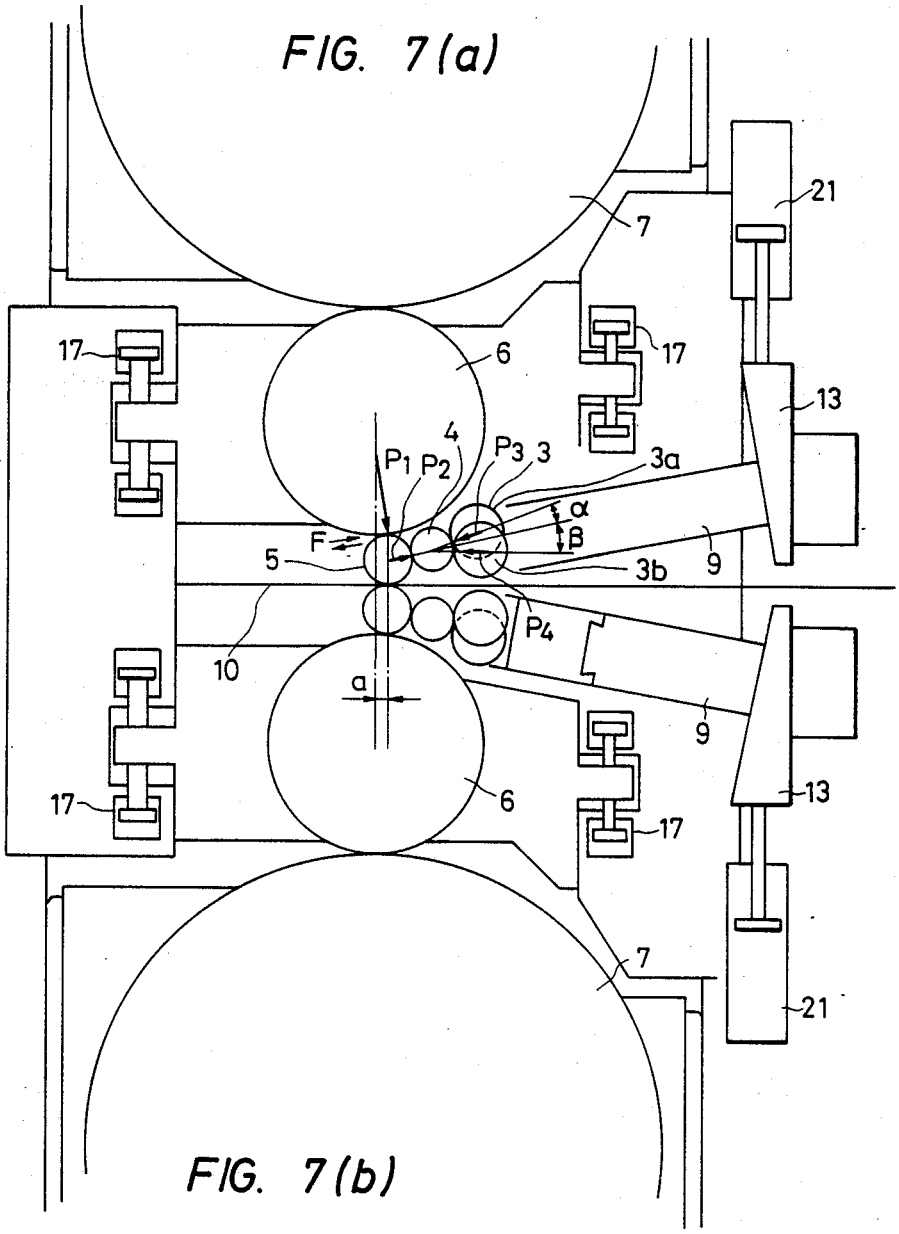
FIG. 7*a* is a construction diagram of another embodiment of the 6-high rolling mill provided with support rollers according to the present invention.
Figure 7B:
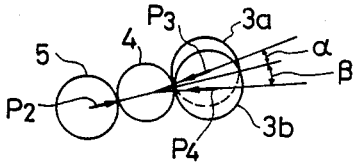
FIG. 7*b* illustrates the directions of the force acting among the support rollers shown in FIG. 7.

According to the knowledge obtained by the present inventors, work rolls having a diameter of about 100–50 mm are preferably used in the multihigh rolling mill, the construction of which is shown in FIG. 1, and work rolls having a diameter of about 200–60 mm in the multihigh rolling mill, the construction of which is shown in FIG. 7 and a description of which will be given later.

If the diameter of the intermediate rolls 6 is set to too low a level, quarter buckling occurs in the work as described with reference to FIG. 5. When the diameter of the work rolls 5 is set selectively to about 200–50 mm, it is necessary that a minimum diameter of the intermediate rolls 6 be set selectively to about 280–420 mm as may be understood from FIG. 5 which shows the limit values, at which quarter buckling occurs in a work having a width of 1200 mm, of the work rolls and intermediate rolls. Namely, the more the diameter of the work roll 5 is reduced, the more it becomes necessary to increase the diameter of the intermediate rolls to a certain extent.

Figure 10:
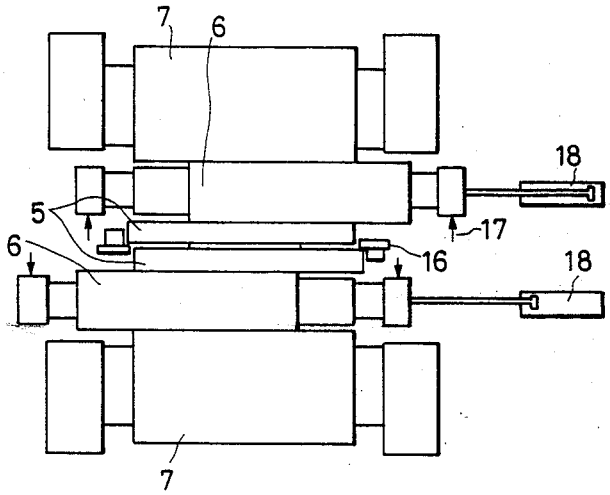
FIG. 10 is a schematic diagram showing the basic construction of the 6-high rolling mill shown in FIG. 1.

As shown in FIG. 10, the work rolls 5 and intermediate rolls 6 are provided with roll bending means 16, 17, respectively, for applying roll bending force thereto. The upper and lower intermediate rolls 6 are joined to roll shifters 18 so that the intermediate rolls 6 can be moved in the opposite axial directions. The shifting of the intermediate rolls, the work roll-bending force and the intermediate roll-bending force and the intermediate roll-bending force are regulated so as to control the crown and shape of a plate material to be rolled.

On one side of each of these upper and lower small-diameter work rolls 5, an intermediate roll 4 supporting the work roll 5 with respect to the whole length thereof, a support roller 3 having divisional rollers 3*a*, 3*b* the axes of which are spaced vertically in a staggered or zig zag manner so as to support the intermediate roller 4, and a support roller 1 supporting this support roller 3. These rollers are arranged in the mentioned order in the direction of the path of the work 10 as shown in FIGS. 2 and 3. A shifter 12 is joined to the intermediate roller 4 as shown in FIG. 2, so as to enable the intermediate roller 4 to be moved in the axial direction thereof and prevent the indentations, which are caused by the pressure from the shoulder portions of the divisional rollers 3*a*, 3*b*, in the intermediate roller 4 from being transferred to the work roll 5.

Driving the work rolls 5 having such a small diameter has problems due to the strength thereof. Therefore, a system for driving the intermediate rolls 6 or backup rolls 7 to transmit the rolling power based on the tangential force F to the small-diameter work rolls 5 is employed in many cases. In such cases, each work roll 5 is disposed so that it is shifted by a distance a from the relative intermediate roll 6.

Consequently, the peripheral force F generated by the driven intermediate rolls also works in the rolling direction of the work rolls 5 in addition to the horizontal component of the rolling load $P_1$ which is transmitted to the work rolls via the intermediate rolls 6. As a result, the driving tangential force F is also applied to the intermediate rollers 4, which support the work rolls 5 in the direction of a path of a work, idle rollers 4, which consist of divisional rollers 3*a*, 3*b*, and support rollers 1, in addition to the horizontal component of the rolling load $P_1$. Moreover, the direction in which the rolling load is applied is to the reverse when a rightward rolling operation is shifted to a leftward rolling operation, and vice versa. When the tensions $T_1$, $T_2$ of the portions of the work 10 which are on the feed side and discharge side, respectively, thereof are different, the differential tension $\Delta T$ is also applied to these rollers. A load $P_2$ is applied as a reaction force of the sum of these loads between the intermediate rollers 4 and work rolls 5.

The offset quantity a corresponding to the distance between the straight line connecting the axes of the upper and lower intermediate rolls 6 and the straight line connecting the axes of the upper and lower work rolls 6 is regulated suitably so that the sum of a horizontal component of a contact load $P_1$ of the work roll 5 and intermediate roll 6 and the peripheral force F certainly becomes positive; the above-mentioned $P_2$ certainly becomes positive; and these value does not become excessively large.

Figure 4:
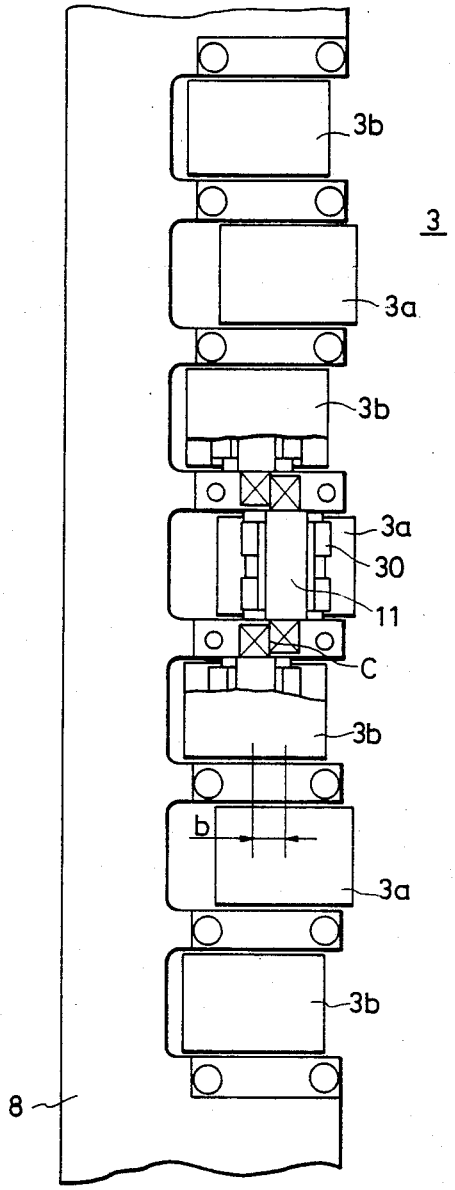
FIG. 4 is a detail view showing the construction of the support roller shown in FIG. 2.

FIG. 4 shows the detailed construction of the support roller 3, in which a plurality of divisional rollers 3*a* and a plurality of divisional rollers 3*b* are arranged in a staggered manner so that the axes of the divisional rollers 3*a*, 3*b* are spaced vertically by b. In order to reduce the distance b between the axes of the divisional rollers 3*a*, 3*b*, each divisional roller is formed unitarily with the outer race of a bearing 30, and a shaft 11 of the divisional roller rectangularly at the portion thereof which is supported on a cradle 8, by subjecting the same portion to flat work.

Therefore, when the multistep rolling mill of the above-mentioned construction is used for a practical rolling operation, the force which will now be described is applied to the intermediate roller 4, support roller 3 and support roller 1. Referring to FIG. 1, let $P_3$ equal a contact load between the upper support rollers 3 and intermediate roller 4, $P_4$ a contact load between the lower support rollers 3*b* and intermediate roller 4, $\alpha$ an angle between the directions of $P_2$, $P_3$, and $\beta$ an angle between the directions of $P_2$, $P_4$. If $\alpha$ and $\beta$ are set so as to have positive values, the intermediate roller 4 contacts two rollers 3*a*, 3*b* from the upper and lower sides, so that the intermediate roller 4 can be stably supported.

The values of $\alpha$, $\beta$ are selected optimumly in accordance with the load capacity and number of the bearings for the support rollers 3*a*, 3*b*. In general, the diameters of the upper and lower support rollers are equal, and the numbers thereof are substantially equal in many cases. In such cases, it is preferable that $\alpha$ and $\beta$ be set to $\alpha \approx \beta$. It is recommendable to set $\alpha$ and $\beta$ to around 3°–15°.

If the cradles 8 holding the support rollers 3*a*, 3*b* are formed so that the cradles can be inclined with respect to a housing 20 in accordance with different diameters of the work roll 5 as shown in FIG. 3, the rolling mill can be adapted to the changes in the diameters of the work roll, support roller 3 and support roller 1, and the variations of the pass line and the thickness of a work. It is also necessary that a support beam 9 be regulated horizontally by wedges 13, which are operated by hydraulic cylinders 13 or screw means as shown in FIG. 2.

Accordingly, as shown in FIG. 1, the intermediate roller 4 in the above-described rolling mill is supported stably on the support roller 3 in which the divisional rollers 3*a*, 3*b* are arranged in a staggered manner, and, moreover, it is understood that the bearings, for the support roller 3, on which only small fores designated by $P_7$, $P_8$ work due to the geometrical construction of the bearings, have only to support loads which are small as compared with $P_3$, $P_4$. Therefore, the sizes of the bearings for the support roller 3 may not be increased. The value of $P_2$ becomes substantially equal to the sum of the values of $P_5$ and $P_6$. Since the support roller 1 is disposed in a position far away from the intermediate roll 4, the diameter of the support roller 1 can be set to a sufficiently high level. Accordingly, the capacity of the bearings can naturally be increased so as to obtain sufficiently good load conditions.

Therefore, if the divisional rollers 3*a*, 3*b* in the support roller 3 are staggered from each other alternatively in the vertical direction by a very small distance b, the support roller 3 having a bearing structure of the largest possible capacity can be set in a small space restricted by the work and intermediate roll, and a sine component of the rolling load, the force transmitted to the bearings via the work roll can be minimized, so that an unavailable load can be reduced.

In the above-described rolling mill, the work roll 5 is shifted by a distance a from the axes of the intermediate roll 6 or backup roll 7 so that a horizontal component of the rolling load $P_1$ is certainly applied to the support roller 1 with the vector of the force, which is applied from the work roll 5 to the support roller 3 via the intermediate roller 4, certainly extending to the support roller 1 through the portion of the support roller 3 which is between the axes of the two staggered divisional rolls 3*a*, 3*b* therein.

If the distance b by which the divisional rollers 3*a*, 3*b* in the support roller 3 are spaced is reduced to the lowest possible level, the angle between the direction in which a load is applied to the bearings for the support roller 3 and that in which a load is applied from the work roll 5 can be minimized, so that the latter load can be set lower than the former load. Namely, only a horizontal component of the load force vector is applied to the bearings for the support roller 3, and, therefore, the diameter of the support roller 3 $D_{Sc}$ can be reduced, this enabling the diameter of the work roll 5 to be reduced.

This means the following. In a support roller 3 having a pair of divisional rollers 3*a*, 3*b*, the distance b between the axes of the divisional rollers can be reduced to a level lower than ½ of the sum of the outer diameter of the support roller and the diameter of the shaft for the support roller. Moreover, if the end portions of the shaft are formed rectangularly, the distance between the axes of the two support rollers can be reduced to the level lower than that of the diameter of the shaft (refer to the portion C in FIG. 4).

In the support rollers shown in FIG. 2, the lengths of the faces of the support roller 1 and support roller 3 are set equal, i.e., consideration is given to these lengths so that the contact pressure between the rollers becomes small. The support roller 1 is supported with the rigidity thereof kept in a sufficiently high level on a support beam 9 fixed to the housing 20.

If there is a space to spare, the support roller 1 may be made of a single roller having bearings at both ends thereof instead of such a divisional roller type roller as shown in FIG. 2.

Figure 5:
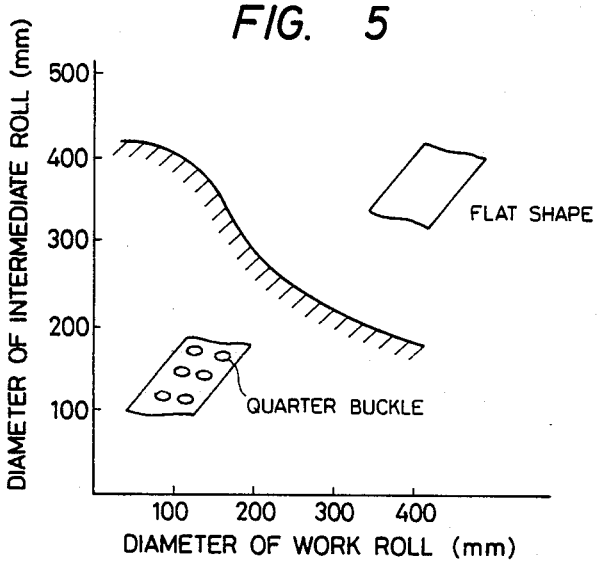
FIG. 5 is a characteristic diagram showing the relationship between the diameters of the work roll and an intermediate roll for carrying out a stable rolling operation.
Figure 6A:
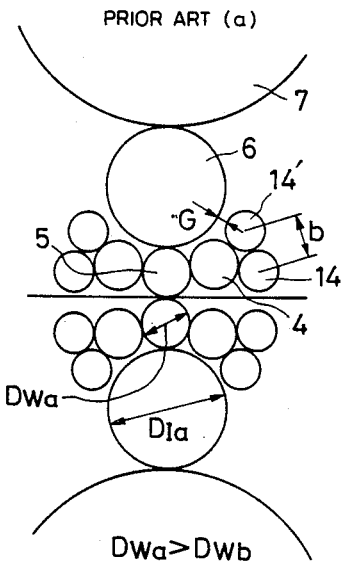
FIGS. 6*a*–6*b* illustrate the relationship between a combination of the diameters of a work roll and an intermediate roll and the diameters of support rollers in a conventional rolling mill structure.
Figure 6B:
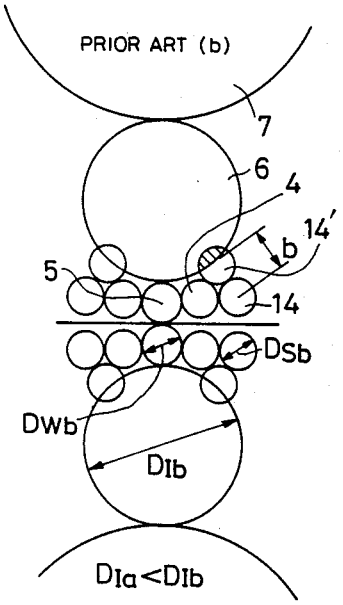
Figure 11:
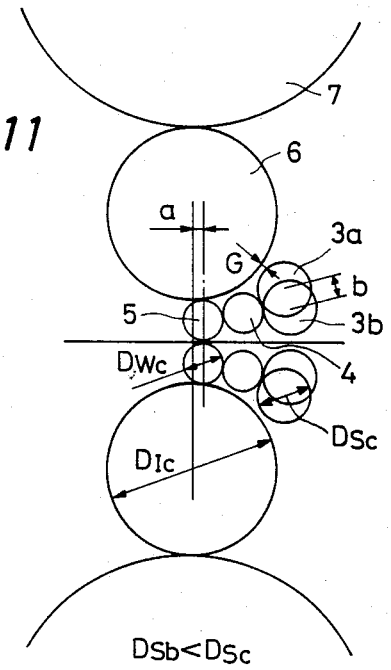
FIG. 11 illustrates the relationship between the work rolls and intermediate rolls and support rollers in an embodiment of the present invention.

FIG. 5 shows the results of investigations for determining the limits of reduction of the diameters of the work roll and intermediate roll for the prevention of an unstable phenomenon called quarter buckling in a rolling operation. This graph shows the limit values of the diameters of these rolls with respect to a work of 1200 mm in width taken as an example. The drawing shows that the diameter of a work roll which enables a work of a hard material, such as stainless steel, or a work of an extremely small thickness of not more than 0.2 mm to be rolled is about 0.2–0.05% of a maximum width of a work. Accordingly, a work roll having a diameter of about 200–50 mm, which may be varied depending upon the width of a work, is preferably employed. As may then be understood from FIG. 5, in order to prevent the quarter buckling from occurring in a work, it is necessary that a diameter of an intermediate roll $D_{Ic}$ of not less than about 280–420 mm be selected. The smaller the diameter of the work roll $D_{Wa}$ that is employed, the more the diameter of the intermediate roll $D_{Ia}$ needs to be increased. If a structure is provided with the above-mentioned intermediate roller 4 and support roller 3 having staggered divisional rollers 3*a*, 3*b*, and support roller 1 as necessary, all of which rollers are arranged in the direction of the path of a work, and such structure is employed as a work roll support structure for a multihigh rolling mill consisting of a combination of such a small-diameter work roll and a large-diameter intermediate roll, then a sufficiently large space can be secured between the intermediate roll 6 and support roller 3 as shown in FIG. 11, so that the diameter of the work roll 5 can be minimized.

As described above, each support roller out of the intermediate rollers and support rollers, which support the work rolls sequentially in the direction of the path of a work in the above-described embodiment of the present invention is made of a plurality of divisional rollers, which are arranged in a staggered manner along the axis of the support roller so that the axes of the divisional rollers are spaced from one another in the vertical direction. Accordingly, a space can be secured between the support roller and the backup roll, which supports the work roll in substantially perpendicular direction, or intermediate roll. Therefore, these roller and roll do not contact each other. This enables the diameter of the work rolls to be reduced, the rolling of a hard material or a thin plate material to be done excellently, and the gloss of the surface of a rolled material to be improved. Moreover, since the intermediate rollers which directly support the work rolls are supported reliably by the two staggered divisional rollers the axes of which are spaced in the vertical direction, the work rolls can be supported stably, and the direction of the load applied from the work rolls to the support rollers extends between the axes of the staggered divisional rollers constituting the support rollers. Consequently, if the distance b between the axes of the staggered divisional rollers is set small, the vertical load imparted to the bearings for the support rollers can be minimized, and the dimensions of the support roller can be reduced. This enables the diameter of the work rolls to be also reduced.

It need scarcely be said that a highly accurate and stable rolling operation can be carried out without causing any quarter buckling to occur.

Another embodiment of the multistep rolling mill according to the present invention will now be described with reference to FIGS. 7 and 8. Since the basic construction of the rolling mill in this embodiment is identical with that of the rolling mill shown in FIGS. 1–3, only the parts of the embodiment of FIGS. 7 and 8 that are different from the parts of the embodiment of FIGS. 1–3 will be described. In short, the basic concept of even the rolling mill of the embodiment of FIG. 7, in which the support rollers 1 are omitted, is the same as that of the rolling mill of the previously-described embodiment. However, it is necessary that the support rollers 3 employ bearings which have a load capacity high enough for the bearings to stand a load $P_3$ or $P_4$.

Figure 8:
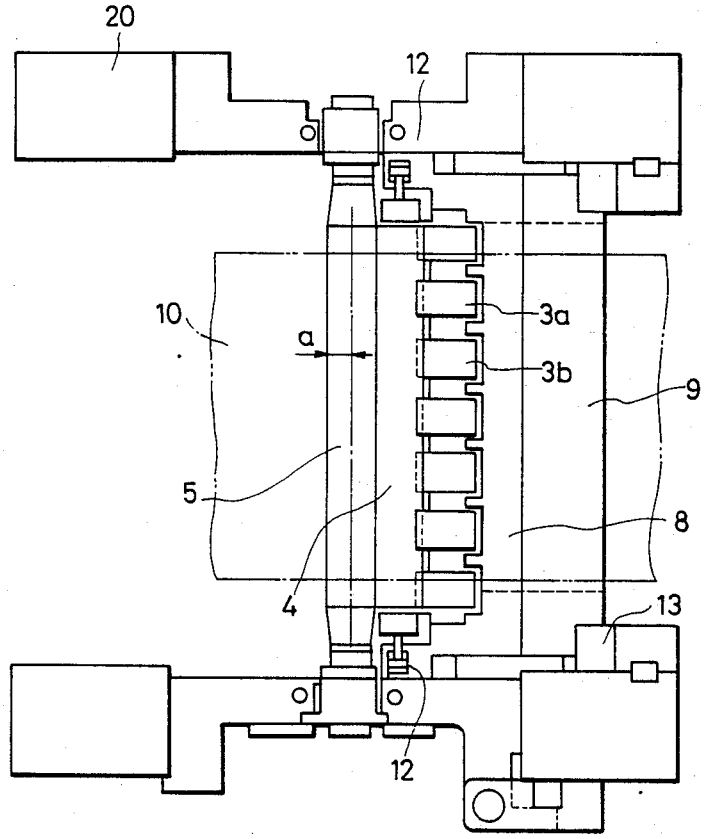
FIG. 8 is a sectional view showing the construction of the support rollers in the rolling mill of FIG. 7.

FIG. 8 shows the arrangement of the rollers supporting the small-diameter work rolls 5 in the direction of the path of a work in the rolling mill of FIG. 7. Referring to FIG. 8, a support roller 3 having a plurality of divisional rollers 3*a*, 3*b* causes at the shoulder portions of the divisional rollers impressions to occur in the surface of an intermediate roller 4. In order to prevent such impressions from being transferred to the work roll 5, the intermediate roller 4 is provided with cylinder means 12 in the same manner as in the embodiment of FIG. 2, which cylinder means 12 are adapted to move the intermediate roller 4 reciprocatingly and repeatedly in the axial direction thereof.

The outputs from the cylinders 12 work so as to press the intermediate roller 4 via suitable bearing boxes, the intermediate roller 4 being moved as it is pressed to its operating side and driving side alternately.

In the multistep rolling mill the construction of which is shown in FIGS. 7 and 8, the support rollers 1 backing up the support rollers 3 are omitted. In this rolling mill, if the angles $\alpha$, $\beta$ between the axes, which are spaced in a staggered manner, of the divisional rollers 3*a*, 3*b* provided in the support roller 3 and that of the intermediate roller 4 are selected to be in the range of about 3–15 degrees, it does not always become necessary to incline the cradle 8 in accordance with the changes of the diameters of the work roll 5, intermediate roller 4 and support roller 3.

Figure 9:
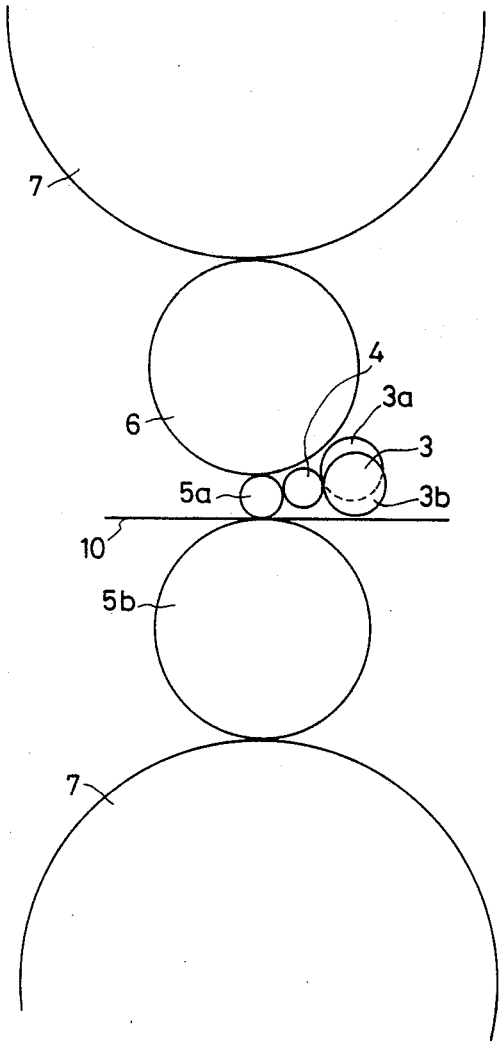
FIG. 9 is a construction diagram of a 5-high rolling mill, still another embodiment of the present invention.

FIG. 9 shows an embodiment employing a work roll unit consisting of a smaller-diameter work roll 5*a* and a larger-diameter work roll 5*b*, and support rollers for the work roll unit, which are provided for the smaller-diameter work roll 5 alone which is disposed on one side of the pass line, this embodiment consisting of a so-called 5-high rolling mill to which the present invention is applied. In this embodiment, a free space is left in the position in which another group of support rollers are not provided, and this free space can be utilized for installing other accessory parts of the rolling mill.

This embodiment is further provided with bending means, the illustration and description of which are omitted, for applying a perpendicular bending force to the larger-diameter work roll 5*b* and intermediate roll 6. The construction of the support rollers for the smaller-diameter work roll 5*a* is identical with that of the support rollers shown in FIG. 8.

As described above, the divisional rollers 3*a*, 3*b* in the support rollers 3 in the multistep rolling mill in each embodiment are disposed in a staggered manner, so that the diameter of the work rolls 5 can be minimized. This enables a hard material, a material difficult to be processed and an extremely thin plate material to be rolled satisfactorily.

Since the divisional rollers 3*a*, 3*b* in the support rollers 3 are disposed in a staggered manner, the work rolls are supported stably, and a rolling operation can thereby be carried out stably.

Since the intermediate rollers 4 are moved reciprocatingly and repeatedly in the axial direction, the partial abrasion which would occur on the intermediate rollers 4 when the shoulder portions of the divisional rollers 3*a*, 3*b* in the support rollers 3 contact the same rollers 4, and the uneven bending or partial abrasion of the work rolls do not cause streaks to occur on a work.

According to the present invention, the work rolls can be supported in geometrically and structurally stable condition, so that the diameter of the work rolls can be minimized. This enables a rolling mill optimumly used for the rolling of a hard material and a material difficult to be processed to be provided.

I claim:

1. A multi-high rolling mill having a plurality of small-diameter work rolls, a plurality of backup rolls supporting said work rolls and arranged in a substantially vertical direction thereof, intermediate rollers supporting said small-diameter work rolls with respect to the whole length thereof, and support rollers supporting said intermediate rollers and arranged in a pass direction of stock being rolled, respectively; and each of said support rollers having a plurality of divisional rollers arranged in the axial direction thereof, each of the divisional rollers having an axis and being arranged in a zigzag manner in accordance with the axial direction of the intermediate roller so that the axes of said divisional rollers are spaded alternately in the vertical direction, and each of said small-diameter work rolls is engaged with a bending means, respectively.

2. A multi-high rolling mill according to claim 1, wherein said axes of said divisional rollers are spaced from one another in the vertical direction and are disposed so that the angles, $\alpha$, $\beta$ which are between a straight line passing through the axes of the associated small-supporting said work roll, and straight lines respectively intersecting the axis of said intermediate roller and those of said upper and lower divisional rollers are each in the range of 3°–15°.

3. A multihigh rolling mill according to claim 1, wherein said intermediate rollers are engaged with shifting means so that said intermediate rollers can be shifted in the axial direction thereof.

4. A multihigh rolling mill according to claim 1, wherein the diameter of said small-diameter work rolls is set in the range of about 5–20% of a maximum plate width.

5. A multi-high rolling mill having a plurality of small-diameter work rolls, a plurality of backup rolls supporting said work rolls and arranged in the substantially vertical direction thereof, intermediate rollers supporting said small-diameter work rolls with respect to the whole length thereof, and support rollers supporting said intermediate rollers; and each of said support rollers having a plurality of divisional rollers arranged in the axial direction thereof, each of the divisional rollers being arranged in a zigzag manner in accordance with the axial direction of the intermediate roller so that the axes of said divisional rollers are aligned with upper and lower divisional rollers relatively in the vertical direction, and second support rollers being further provided to support the relative upper and lower divisional rollers, commonly.

6. A multihigh rolling mill according to claim 5, wherein said small-diameter work rolls are provided with bending means for applying a roll-bending force thereto.

7. A multi-high rolling mill according to claim 5, wherein each of said second support rollers is disposed so that the axis of the second support roller is positioned in the vicinity of a straight line passing through the axes of the associated small-diameter work roll and intermediate roller.

8. A multi-high rolling mill according to claim 7, wherein said axes of said divisional rollers are spaced from one another in the vertical direction and are disposed so that the angles $\alpha$, $\beta$ which are between a straight line passing through the axes of the associated small-diameter work roll and intermediate roller supporting said work roll, and straight lines respectively intersecting the axis of said intermediate roller and those of said upper and lower divisional rollers are each in the range of 3°–15°.

9. A multihigh rolling mill according to claim 5, wherein said intermediate rollers are engaged with shifting means so that said intermediate rollers can be shifted in the axial direction thereof.

10. A multihigh rolling mill according to claim 5, wherein the diameter of said small-diameter work rolls is set in the range of about 5–20% of maximum width of the rolling stock.

11. A multi-high rolling mill having upper and lower work rolls, and upper and lower backup rolls all of which are disposed in a substantially vertical direction, an intermediate roll disposed between at least one of said work rolls and the relative backup roll, an intermediate roller supporting at least said work roll out of said upper and lower work rolls with resect to the whole length thereof in the pass direction of stock being rolled, and a support roller supporting said intermediate roller; and said support rollers having a plurality of divisional rollers arranged in the axial direction thereof, each of said divisional roller having an axis and being spaced alternately in the vertical direction, and each of said work rolls being engaged with a bending means, respectively.

12. A multi-high rolling mill according to claim 11, wherein said work rolls comprise a smaller-diameter work roll and a larger-diameter work roll, said intermediate roller and said support roller being disposed with respect to said smaller-diameter work roll.

13. A multi-high rolling mill according to claim 12, wherein said larger-diameter work roll and said intermediate roller are provided with bending means for applying a perpendicular roll-bending force thereto.

14. A multi-high rolling mill according to claim 11, wherein said axes of said divisional rollers the aces are spaced from one another in the vertical direction and are disposed so that the angles $\alpha$, $\beta$ which are between a straight line passing through the axes of the associated work roll and relative intermediate roller, and straight lines respectively intersecting the axis of said intermediate roller and the axes of said upper and lower divisional rollers are each in the range of 3°–15°.

15. A multihigh polling mill according to claim 11, wherein said intermediate rollers are engaged with shifting means so that said intermediate rollers can be shifted in the axial direction thereof.

16. A multihigh rolling mill according to claim 11, wherein the diameter of said work rolls is set in the range of about 5–20% of a width of the rolling stock.

17. A multihigh rolling mill according to claim 16, wherein intermediate rollers are provided between said upper and lower work rolls and said upper and lower backup rolls, and each of said intermediate rolls is engaged with a roll moving means so that said intermediate roll can be shifted in the axial direction thereof.

18. A multihigh rolling mill according to claim 17, wherein said upper and lower work rolls and said upper and lower intermediate rolls are provided with bending means for applying a roll-bending force in the perpendicular direction thereof.

19. A multi-high rolling mill having upper and lower work rolls disposed in a substantially vertical direction, upper and lower backup rolls, upper and lower intermediate rolls disposed between said work rolls and said backup rolls and capable of being axially shifted, intermediate rollers supporting said work rolls with respect to the whole length thereof in a pass direction of stock being rolled, and support rollers supporting said intermediate rollers;

each of said support rollers having a plurality of divisional rollers arranged in the axial direction thereof, said divisional rollers being arranged in a zig zag manner in accordance with the axial direction of the intermediate roller so that the axes of said divisional rollers are aligned with upper and lower divisional rollers relatively in the vertical direction, second support rollers providing support for the relative upper and lower divisional rollers, commonly, and the diameter of said work roll being set in the range of about 5–20% of maximum width of the rolling stock.

20. A multi-high rolling mill according to claim 19, wherein each of said second support rollers is in a position in the vicinity of a straight line passing through the axes of the associated work roll and intermediate roller, and said divisional rollers axes are spaced from one another in the vertical direction so that the angles $\alpha$, $\beta$ which are between a straight line passing respectively through the axes of the associated work roll and intermediate roller, and straight lines connecting the axis of said intermediate roller and the axes of said upper and lower divisional rollers are in the range of 3°–15°.

21. A multihigh rolling mill according to claim 20, wherein said intermediate rollers are engaged with shifting means so that said intermediate rollers can be shifted reciprocatingly in the axial direction thereof.

22. A multihigh rolling mill according to claim 20, wherein said work rolls and said intermediate rolls are provided with bending means for applying a perpendicular roll-bending force thereto.

23. A multi-high rolling mill having a plurality of small-diameter work rolls for rolling a rolling stock, a plurality of backup rolls for supporting said work rolls and being arranged in a substantially vertical direction with respect to a pass direction of the rolling stock;

intermediate rollers supporting said small-diameter work rolls along a whole length of said small-diameter work rolls, and support rollers for supporting said intermediate rollers and being arranged in the pass direction of the rolling stock;

each of said support rollers being divided into a plurality of divisional rollers and having separate axes of rotation, and each of said axes of said divisional rollers being arranged alternately one on each side of an axially extending line parallel to and in alignment with said axes of both corresponding ones of said small-diameter work rolls and said intermediate rollers, and each of said small-diameter work rolls being engaged with means for bending said small-diameter work rolls, respectively.

24. A multi-high rolling mill according to claim 23, wherein the axes of said divisional rollers are arranged on each side of said axially extending line by an angular amount with respect to the axis of the associated intermediate roller in the range of 3°–15°.

25. A multi-high rolling mill according to claim 23, wherein said intermediate rollers are engaged with shifting means for shifting said intermediate rollers in the axial direction.

26. A multi-high rolling mill having upper and lower work rolls disposed in a substantially vertical direction for rolling a rolling stock upper and lower backup rolls, and upper and lower intermediate rollers disposed between said intermediate rollers and said backup rolls;

said intermediate rollers supporting said work rolls along a whole length of said work rolls, and upper and lower support rollers for supporting said intermediate rollers respectively and being arranged in the pass direction of the rolling stock; and each of said upper and lower support rollers being divided into a plurality of divisional rollers having separate axes of rotation, and each of said axes of said upper and lower divisional rollers respectively being arranged alternately one on each side of a corresponding axially extending line parallel to and in alignment with said axes of both the corresponding ones of said work rolls and said intermediate rollers, and each of said work rolls being small-diameter work rolls having a diameter in the range of 5 to 20 percent of a width of the rolling stock.

27. A multi-high rolling mill according to claim 23, wherein the axes of said divisional rollers are arranged on each side of said axially extending line by an angular amount with respect to the axis of the associated intermediate roller in the range of 3°–15°.

28. A multi-high rolling mill according to claim 23, wherein said intermediate rollers are engaged with shifting means for shifting said intermediate rollers in the axial direction.

* * * * *